US005459967A

United States Patent [19]

Bodtker

[11] Patent Number: 5,459,967

[45] Date of Patent: Oct. 24, 1995

[54] ADJUSTABLE SUPPORT STRUCTURE

[76] Inventor: Carl E. Bodtker, 6250 Lucas Valley Rd., Nicasio, Calif. 94946

[21] Appl. No.: 194,716

[22] Filed: Feb. 10, 1994

[51] Int. Cl.[6] ..... E04C 3/00

[52] U.S. Cl. ..... 52/93.1; 182/82; 312/191; 52/127.2; 52/252; 52/641; 52/649.7; 52/651.06

[58] Field of Search ..... 182/82; 52/127.2, 52/252, 93.1, 506.3, 506.4, 508, 638, 641, 649.6, 649.7, 651.01, 651.06, 651.07, 651.1, 651.3, 781.3, 92.1, 481.1, 90.1, 63.2; 312/191, 192, 208.2

[56] References Cited

U.S. PATENT DOCUMENTS

| | | | |
|---|---|---|---|
| 3,083,795 | 4/1963 | Land | 52/632 |
| 3,356,330 | 12/1967 | Rambelle | 52/632 |
| 3,656,269 | 4/1972 | Witschel et al. | 52/638 |
| 3,897,668 | 8/1975 | McDonnell | 52/632 |
| 3,973,367 | 8/1976 | Johnson et al. | 52/92.1 X |
| 4,068,927 | 1/1978 | Camardo | 52/127.2 X |
| 4,122,916 | 10/1978 | Strobel | 182/82 |
| 4,435,940 | 3/1984 | Davenport et al. | 52/641 |
| 4,878,323 | 11/1989 | Helson | 52/127.2 |
| 4,942,940 | 7/1990 | Boeshart | 182/82 |
| 5,367,852 | 11/1994 | Masuda et al. | 52/651.1 X |

*Primary Examiner*—Wynn E. Wood

*Attorney, Agent, or Firm*—Samuel A. Kassatly; Frazzini & Kassatly

[57] ABSTRACT

An adjustable support structure is used to support various types of roofs, such as flat, single slope and double slope roofs. The support structure includes a channel shaped post, a load beam assembly connected to the post at about its uppermost end, an adjustable bracket adjustably secured to the load beam assembly, and a purlin secured to the adjustable bracket, at a generally angular position relative to the load beam assembly, for supporting the roof. The adjustable bracket includes an upwardly oriented generally U-shaped seat which is secured to a downwardly oriented generally U-shaped saddle, such that the saddle is mounted snugly across the load beam assembly, and is adjustably connected thereto. An extender is adjustably secured to the post and to the load beam assembly. The extender includes a generally U-shaped seat, which supports; it is connected to the load beam assembly, such that the extender seat can be adjustably connected to the load beam assembly along the horizontal direction. The adjustable support structure further includes a bow girt assembly, for simultaneous use as a thermal bow girt and a wind girt. The bow girt assembly includes an outer girt bracket, an inner girt bracket, and a channel secured to a wall at a optimal bow region of the wall. The outer girt bracket is slidably connected to the inner girt bracket, and both the outer girt bracket and the inner girt bracket are connected between the post and the wall.

19 Claims, 9 Drawing Sheets

4/9

ADJUSTABLE SUPPORT STRUCTURE

BACKGROUND OF THE INVENTION

The present invention relates in general to the construction field, and more specifically to support structures, for a multitude of various applications. In particular, the present adjustable support structure can be used in warehouses, temperature controlled storage buildings, and several other similar applications.

Warehouses and refrigerated buildings using pallet racks for inventory storage or other purposes, conventionally employ steel post and beam constructions, in addition to the pallet rack support structures. This construction method involves significant redundancy in materials and labor. Wherefore, Symons-Bodtker, Associates, the assignee of the present application has designed and used a support structure, which eliminates the need for the conventional steel post and beam constructions, and which functionally combines the roles of the post and beam construction and the pallet rack structure.

The support structure includes a plurality of upright frames or posts, which are connected to a plurality of horizontal load beams. In turn, the load beams are non-adjustably connected to a plurality of purlins, by means of loose brackets that are disposed between the load beams and the purlins, for supporting a ceiling. Therefore, the support structure can be simultaneously used to support the ceiling and to accommodate the pallets. This support structure design has proven to be significantly more efficient and cost effective than the conventional steel post and beam constructions.

Nonetheless, there is still a need for an improved support structure, which further simplifies, and allows added flexibility in the assembly and installation process.

SUMMARY OF THE INVENTION

Accordingly, it is an object of the present invention to provide a new support structure, which can be simultaneously used to support overhead constructions, such as different types of ceilings, and to accommodate pallet racks.

It is another object of the present invention to provide a new support structure which is adjustable, which allows for greater manufacturing tolerances, and which is installable on leveled grounds or uneven terrains.

It is also a further object of the present invention to provide an adjustable bow girt assembly, which can be simultaneously used as a wind bow girt and a thermal bow girt.

Briefly, the above and further objects of the present invention are realized by an adjustable support structure which is used to support various types of roofs, such as flat, single slope and double slope roofs. The support structure includes a channel shaped post, a load beam assembly connected to the post at about its uppermost end, an adjustable bracket adjustably secured to the load beam assembly, and a purlin secured to the adjustable bracket, at a generally angular position relative to the load beam assembly, for supporting the roof.

The adjustable bracket includes an upwardly oriented generally U-shaped seat which is secured to a downwardly oriented generally U-shaped saddle, such that the saddle is mounted snugly across the load beam assembly, and is adjustably connected thereto.

An extender is adjustably secured to the post and to the load beam assembly. The extender includes a generally U-shaped seat, which supports; it is connected to the load beam assembly, such that the extender seat can be adjustably connected to the load beam assembly along the horizontal direction.

The extender further includes a column which is secured to the seat, and which extends therefrom at various lengths. The extender column is generally U-shaped and includes a central flat section, and two parallel side flanges. The side flanges include a plurality of through holes along at least part of their axial lengths. The extender column is dimensioned to slide snugly along the post to the desired position, in order to provide the desired adjustment to the load beam assembly.

The adjustable support structure further includes a bow girt assembly, for simultaneous use as a thermal bow girt and a wind girt. The bow girt assembly includes an outer girt bracket, an inner girt bracket, and a channel secured to a wall at a optimal, such as the maximum bow region of the wall. The outer girt bracket is slidably connected to the inner girt bracket, and both the outer girt bracket and the inner girt bracket are connected between the post and the wall.

The channel extends along the entire perimeter of the wall, and the central flat section includes a proximal and a distal end. The outer girt bracket includes a central flat section which extends into two shoulders, wherein the distal end of the central section is secured to the channel, and the proximal end of the central section includes an elongated slot for adjustable connection to the inner girt bracket.

The inner girt bracket includes a generally U-shaped extension which is secured to a saddle, such that the extension is adjustably connected to the flat section by means of one or more shoulder bolts, in order to permit the outer girt bracket to slidably move relative to the extension, and thus relative to the inner girt bracket. The bow range of the wall is determined and limited by the length and shape of the bore.

BRIEF DESCRIPTION OF THE DRAWINGS

The above and other features of the present invention and the manner of attaining them, will become apparent, and the invention itself will be better s understood, by reference to the following description and the accompanying drawings, wherein.

DETAILED DESCRIPTION OF THE PREFERRED EMBODIMENT

Figure 1:
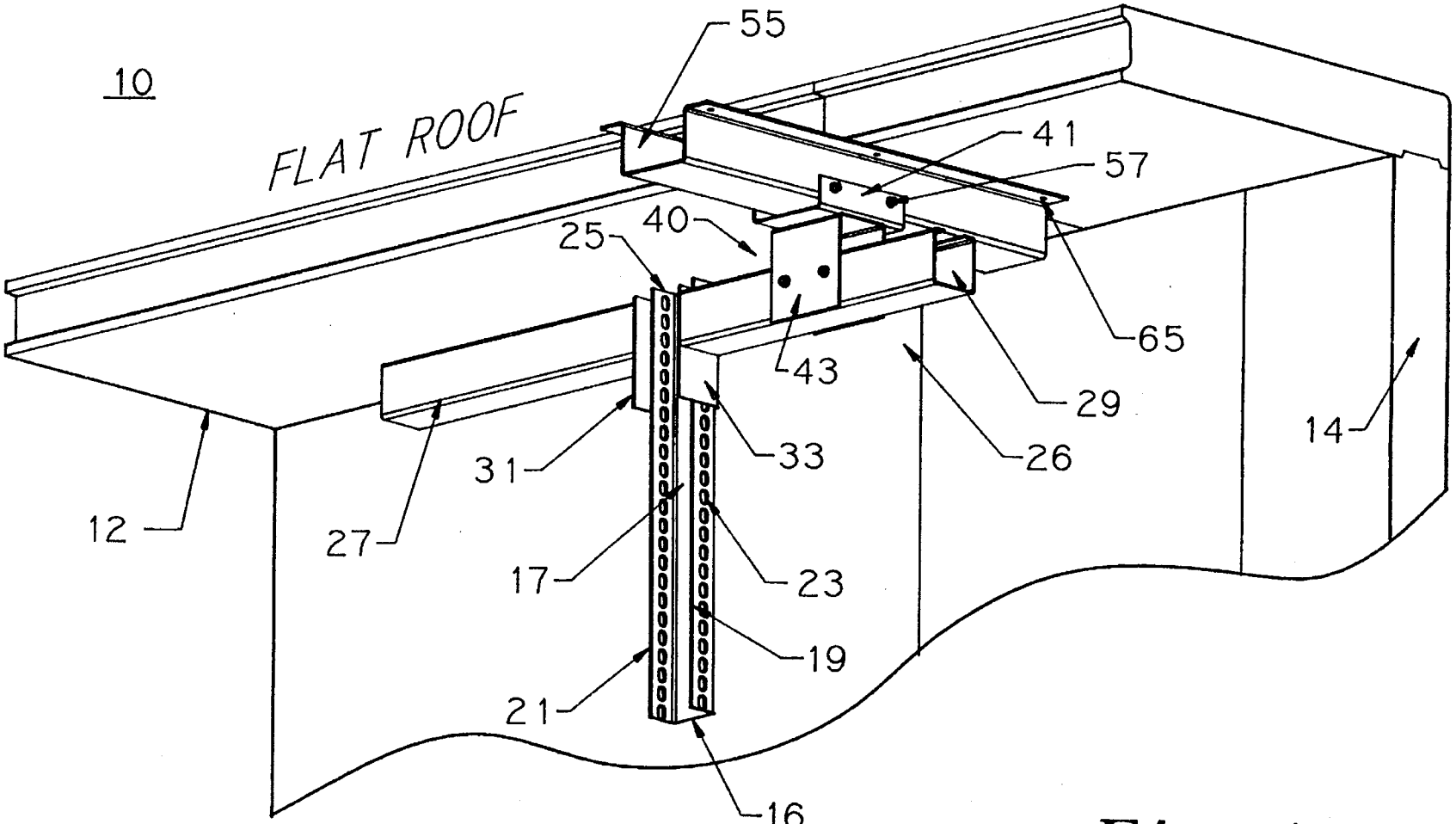
FIG. 1 is a schematic partial representation of an adjustable support structure, which is constructed according to the present invention, and which is shown supporting ceiling panels.
Figure 2:
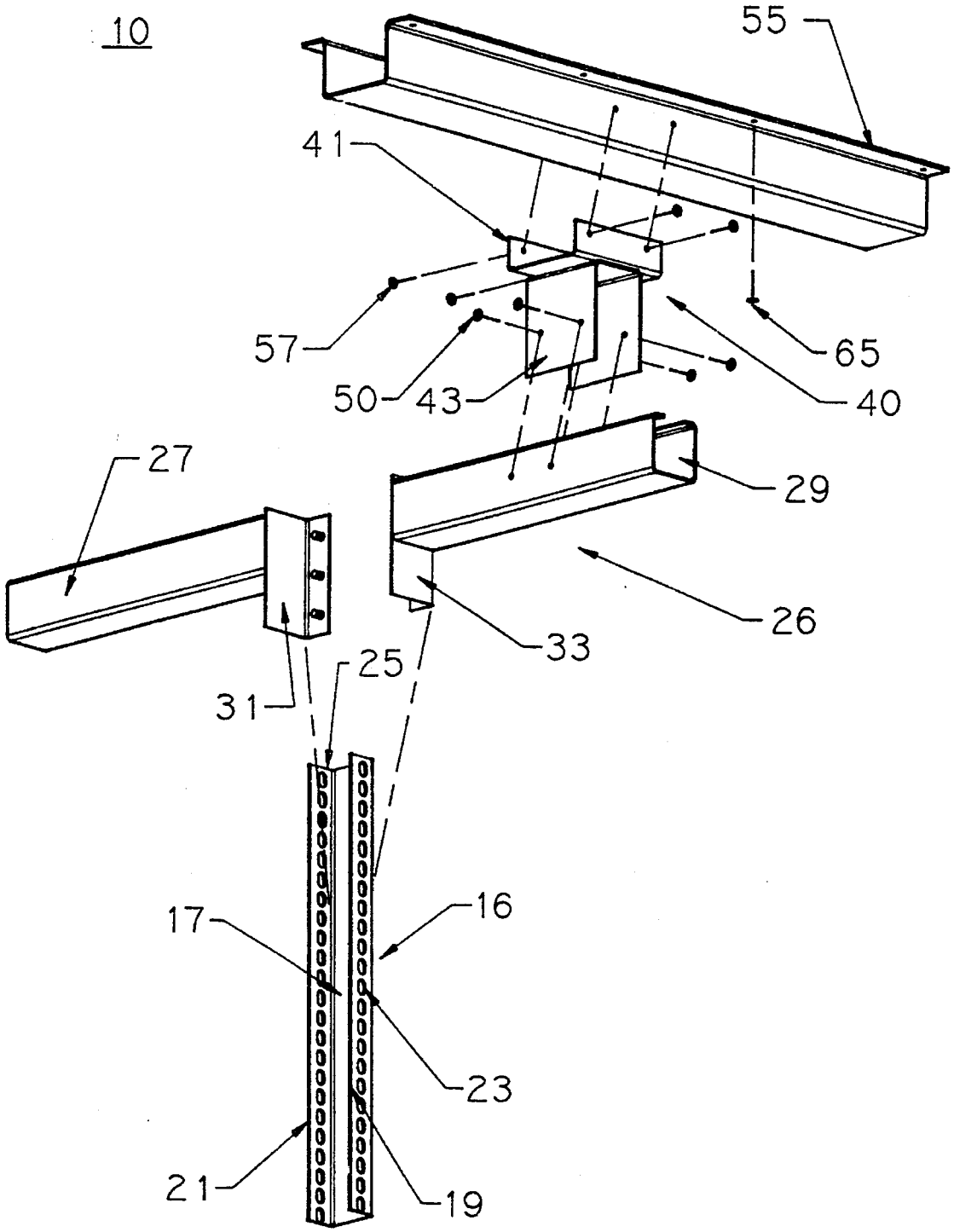
FIG. 2 is an exploded assembly view of the adjustable support structure of FIG. 1.
Figure 3:
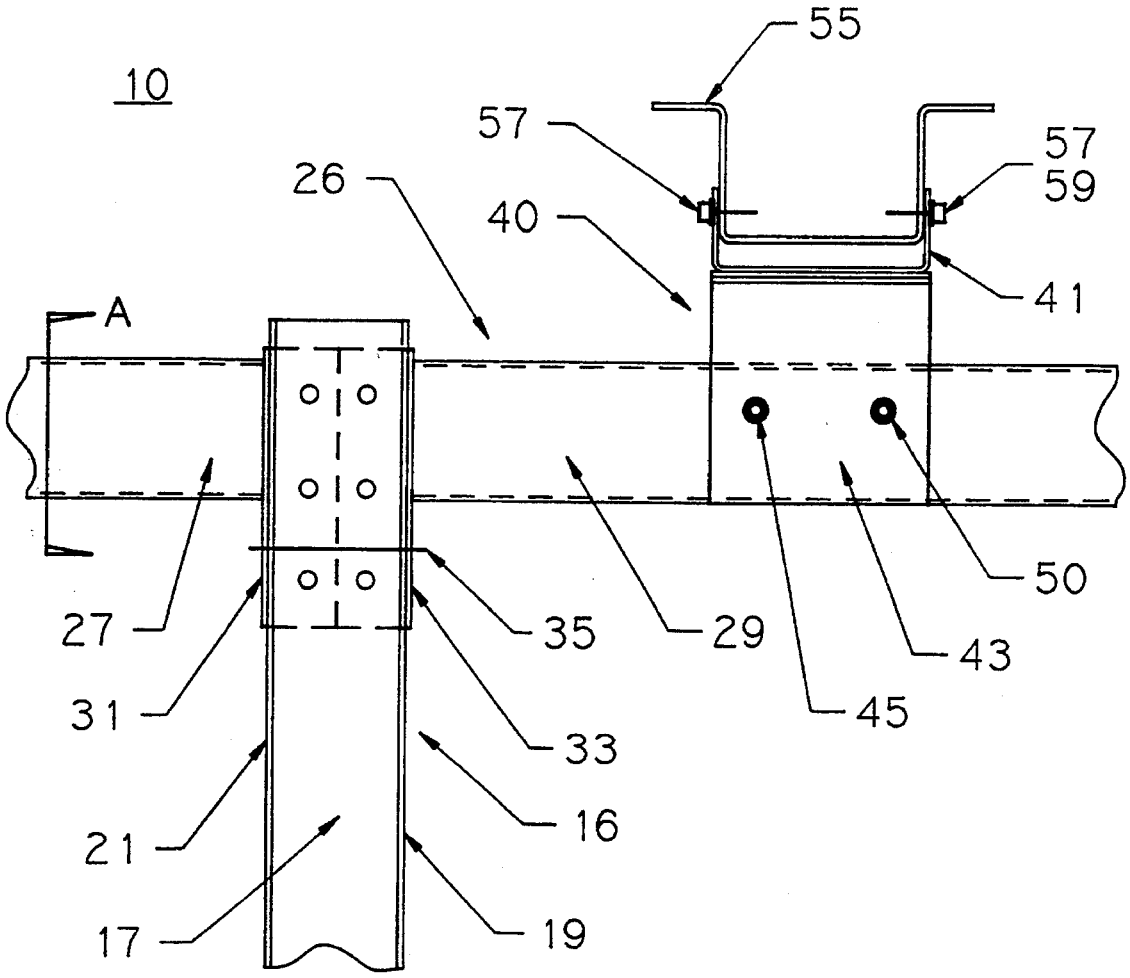
FIG. 3 is a schematic side view of the adjustable support structure of FIGS. 1 and 2, shown assembled.

Referring now to the drawings, and more particularly to FIGS. 1, 2 and 3 thereof, there is schematically illustrated an adjustable support structure 10, which is constructed in accordance with the present invention. A plurality of similar adjustable support structures 10 are interconnected so as to form a support system, which can be simultaneously used to support overhead constructions such as a flat roof or ceiling 12, and to accommodate a plurality of pallet racks (not shown). In this particular example, the ceiling 12 is formed of a plurality of panels which are connected to side wall panels 14.

The support structure 10 includes an upright frame or post 16, which is fixed to the ground (not shown) at one end, and which extends upwardly vertically toward the ceiling 12. The post 16 is generally U-shaped, and includes a central flat section 17, and two parallel side flanges 19 and 21. The flanges 19 and 21 are similar and include a plurality of through holes 23 along at least part of their axial lengths. In the preferred embodiment, adjacent holes 23 are separated by a center to center distance of two inches. In the present illustration, the holes 23 are identical and circularly shaped (i.e., ½ inch diameter).

A plurality of similar posts 16 are vertically installed, and are distally separated from each other, by predetermined distances, in order to accommodate the pallets, and to adequately support the ceiling 12. The support structure 10 further includes a load beam 26, which is connected to the post 16, at about its uppermost end 25.

In the present embodiment, the load beam 26 includes two similar load beam sections 27 and 29. Each of these load beam sections 27 and 29 terminates into an L-shaped flat bracket, i.e., 31 and 33, for connection to the post 16, by conventional means, such as bolts or tap 35. For example, the load beam section 27 is shop welded to the bracket 31, which is connected to the side flange 21 and the central section 17 of the post 16. Similarly, the load beam section 29 is shop welded into the bracket 33, which is bolted to the side flange 19 and the central section 17 of the post 16.

Figure 4:
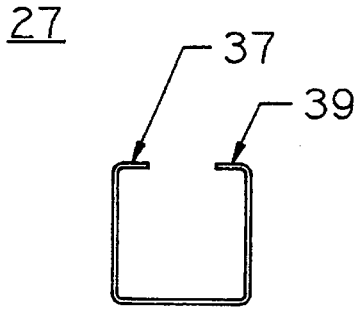
FIG. 4 is an enlarged schematic end view of a load beam section forming a part of the adjustable support structure of FIGS. 1 through 3.

Each beam section, i.e., 27 extends substantially horizontally between, and is connected to two adjacent posts 16. FIG. 4 illustrates an end view of the beam section 27 along the direction of the arrow A in FIG. 3, and shows it as having a U-shaped section, which extends inwardly into two reinforcement lips 37, 39. The dimension and shape of the beam section 27 depends on several factors, such as applicable loads.

The adjustable support structure 10 further includes an adjustable bracket 40, which includes an upwardly oriented generally U-shaped seat 41 which is secured to a downwardly oriented generally U-shaped saddle 43. The saddle 43 is mounted snugly across the beam section 29, and is connected thereto by means of self tapping screws or bolts 50.

One important feature of the bracket 40 is its adjustability with respect to the load beam 29. For this purpose, the saddle 43 includes two through holes 45, through which matching self tapping screws or bolts 50 can be inserted for connection to the beam section 29. Some of the holes, i.e., 45, may be elongated bores for allowing very fine adjustments of the saddle position relative to the load beam 29.

In the preferred embodiment, the seat 41 snugly supports, and is firmly connected to a purlin 55 by means of conventional means, such as self tapping screws or bolts and nuts 57, 59, respectively. In alternative embodiments, the seat 41 could be designed similarly to the saddle 43, in order to allow for added degrees of adjustment between the purlin 55 and the load beam 26.

Figure 5:
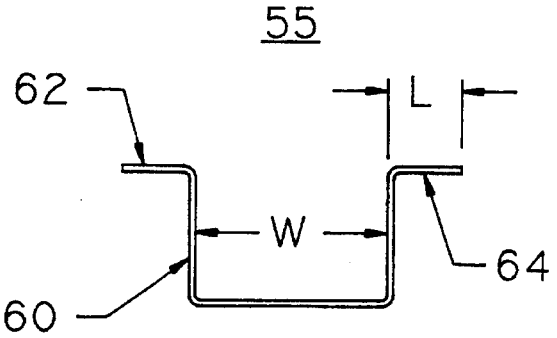
FIG. 5 is an enlarged side view of a purlin forming a part of the adjustable support structure of FIGS. 1 through 3.

The purlin 55 includes has an elongated and generally uniform length, and is seated, at least partially, in the adjustable bracket 40, and which supports the ceiling 12. Referring more specifically to FIG. 5, there is illustrated a side section of the purlin 55. It includes a U-shaped section 60, which extends outwardly, along almost its entire axial length, into two lips 62 and 64.

The U-shaped section is designed such that its outer surface fits snugly, at least partially, inside the seat 41. In the preferred embodiment, the internal width "W" of the U-shaped section 60 is about 4.5 inches. The two lips 62 and 64 are substantially identical, and have a width "L" of about 1.5 inches. The purlin 55 is made of 10 gauge steel. The lips 62 and 64 are secured to the ceiling 12 with conventional fastening means, such as self tapping screws 65.

The new design of the purlin 55 presents significant advantages over the conventional support structures, in that the lips 62 and 64 are secured to the ceiling 12, without requiring additional brackets. As a result, the ceiling 12 is securely connected to the support structure 10, and thus, the installation of the purlins 55 is facilitated, and rendered cheaper and more convenient.

The present inventive support structure can be used with flat roofs, single sloped roofs, double sloped roofs and various other types of ceilings, such as in mezzanines. While FIGS. 1 through 3 illustrate the inventive support structure 10 as being used with a flat roof 12, FIGS. 6 through 9 illustrate a second embodiment of the inventive support structure, for use with a double sloped roof 80.

Figure 6:
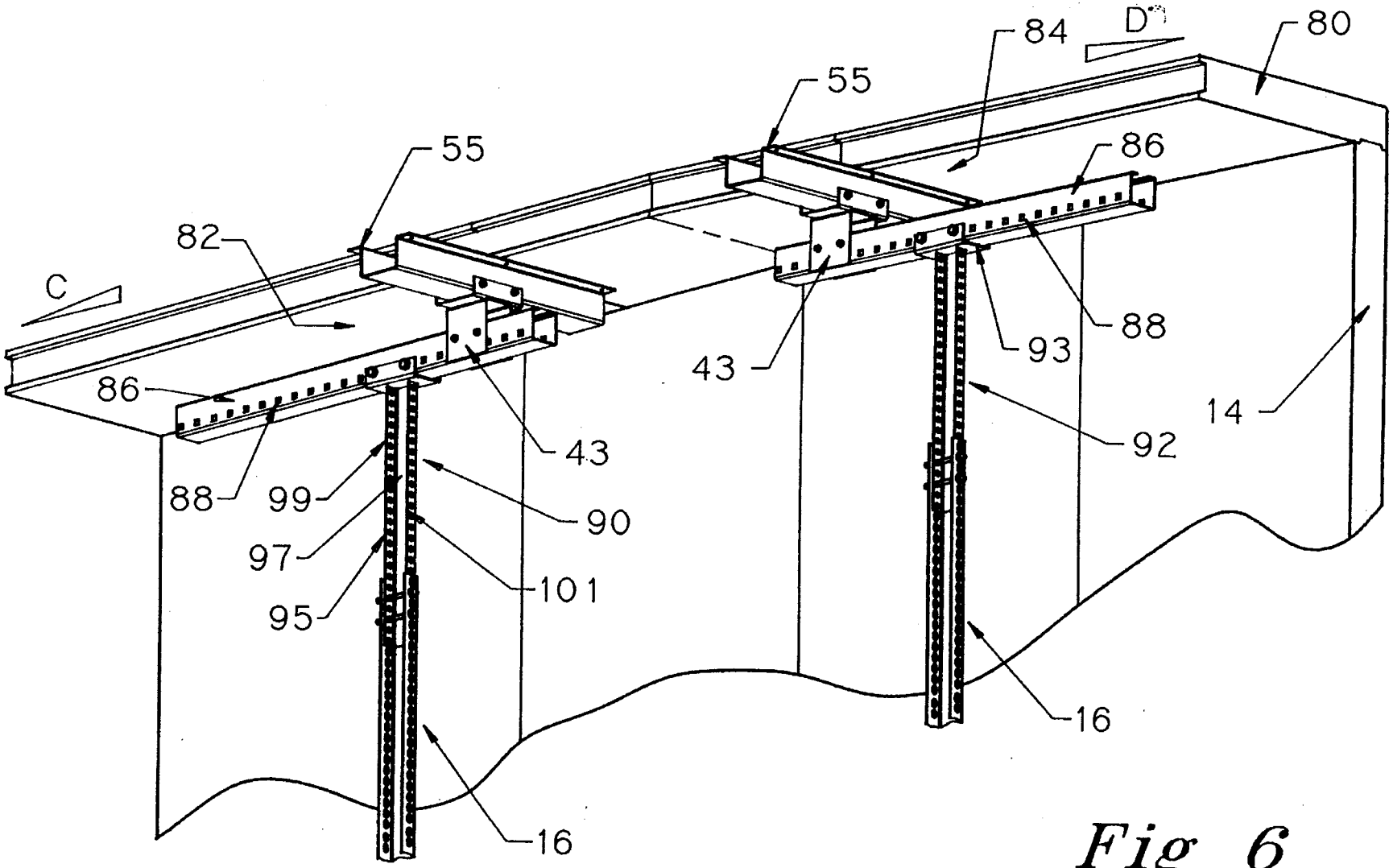
FIG. 6 is a schematic partial representation of a second embodiment of a first and second adjustable support structures, which are constructed according to the present invention, and which are shown supporting ceiling panels.

FIG. 6 illustrates two support structures 82 and 84, which are shown supporting the two slopes of the ceiling 80. The slope representations C and D indicate the direction of the ceiling slopes. Both support structures 82 and 84 are generally similar in design and construction, and therefore only the support structure 82 will be described in more detail.

Figure 7:
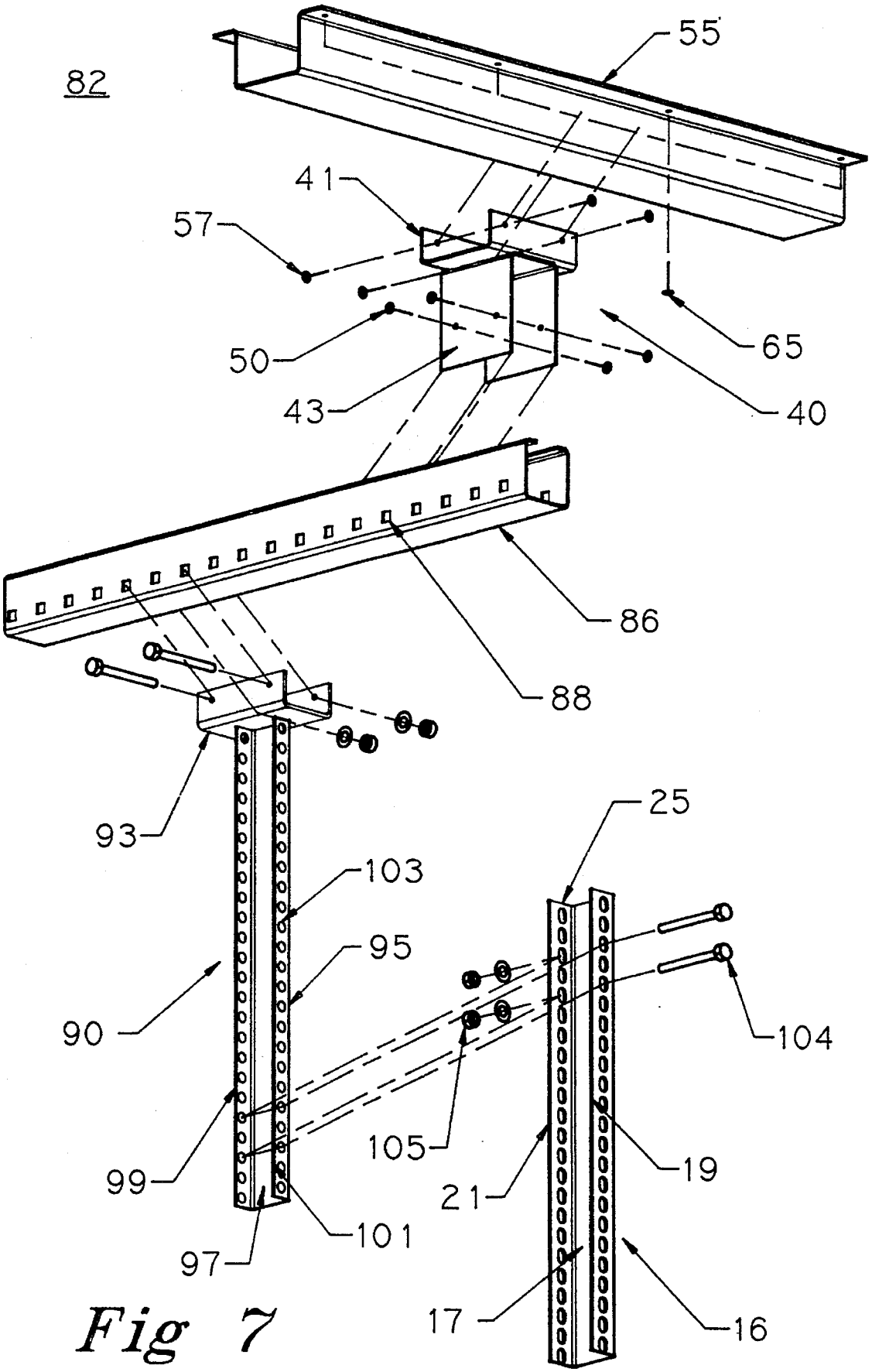
FIG. 7 is an exploded assembly view of a representative adjustable support structure shown in FIG. 6.

As further shown in FIG. 7, the support structure 82 includes a purlin 55, which is seated in an adjustable bracket 40. The holes in the brackets are spaced apart by a predetermined distance. Both the purlin 55 and the adjustable bracket 40 are similar to the purlin and bracket with the same corresponding numeral references used in the first embodiment of the support structure 10. The support structure 82 further includes a load beam 86 which forms a continuous channel, and which is adjustably connected to the brackets 40.

While in the first embodiment, the load beam 26 was formed of a plurality of sections, i.e., 27, 29, each of which is generally connected between two adjacent posts 16, the load beam 86 according to this second embodiment includes a continuous channel which extends for a greater span than the post 16. FIG. 6 shows the load beam 86 as having two sections, for illustration purposes. It should however be noted that the load beam 86 can alternatively be made of several sections.

The load beam 86 also includes a plurality of holes and/or a plurality of elongated slots 88 along its length, for connection to the saddles 93 of the post extenders, such as post extenders 90, 92, as it will be explained later in more detail. Consequently, the continuous load beams 86 can now be connected to the adjustable brackets 40 at any desired position along their lengths.

As a result, the combination of the new designs of the bracket 40 and the load beam 86, allows the purlins 55, and thus the ceiling 80 to be adjustably and accurately supported. For instance, the purlin 55 can be adjustably seated onto the seat 41 of the bracket 40, along the vertical direction. Further, the load beam 86 can be adjustably connected to the saddle 43 of the bracket 40, along the vertical and horizontal directions.

Furthermore, the support structure 82 further includes the post extender 90, for providing a desired added length to the post 16. The extender is adjustably connected to the load beam 86 along the horizontal directions, and is further adjustably connected to the post 16 along the vertical direction. As a result, the support structures 82 and 84 can support various types of roofs, such as flat, single slope or double slope roofs, using posts 16 having the same (but not necessarily) length.

The adjustable extender 90 includes a generally U-shaped seat 93, which supports, and is connected to the load beam 86. The seat 93 is generally similar in design to the seat 41, and can be connected to the load beam 86 along the horizontal direction.

The extender 90 further includes a column 95 which is generally shaped similarly (but not necessarily) to the post 16. The column 95 is securely connected to the seat 93, and extends therefrom at various lengths. The column 95 is U-shaped and includes a central flat section 97, and two parallel side flanges 99 and 101. The flanges 99 and 101 are similar and include a plurality of through holes 103 along at least part of their axial lengths. In the preferred embodiment, adjacent holes 103 are separated by a center to center distance of one inch.

It should however be understood to those skilled to the art, after reviewing the present invention, that the column 95 can have different shapes. For instance, the flanges 99 and 101 of the column 95 could extend inwardly into two reinforcement lips, similarly to the lips 37 and 39 of the load beam section 27, shown in FIG. 4. Other shapes are also contemplated by the present invention.

The column 95 is dimensioned such that it slides snugly along the post 16, to the desired position, in order to provide the desired adjustment to the load beam 86. Thereafter, the column 95 is tightened to the post 16 by conventional means, such as bolts and nuts 104, 105. The seat 93 is preferably made of 10 gauge steel, and the column 95 is made of 7 gauge steel.

Figure 9:
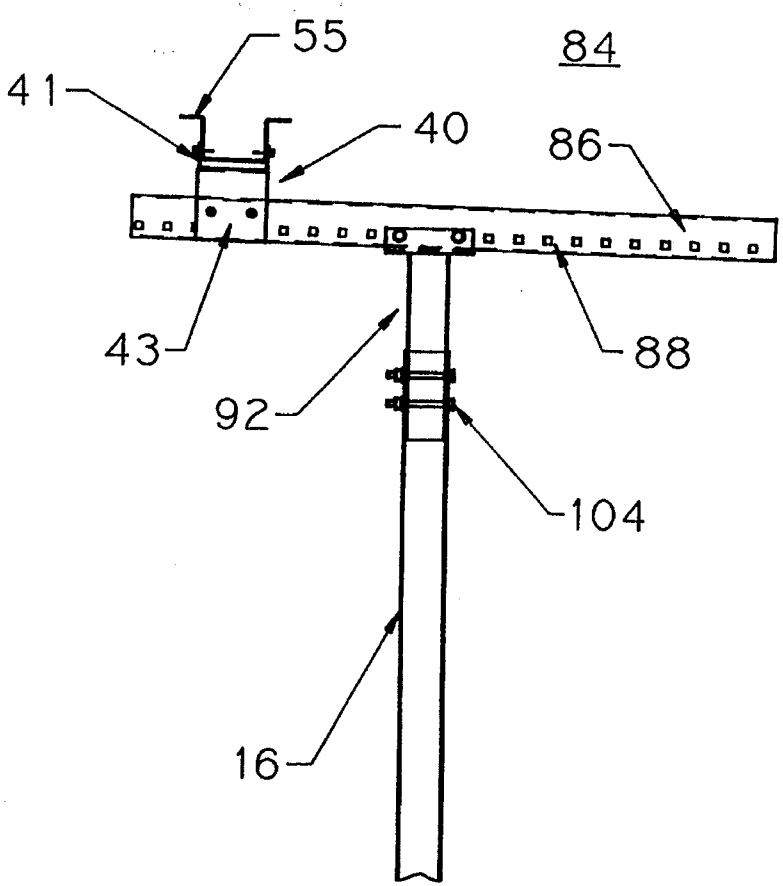
FIG. 9 is a schematic side view of the second adjustable support structure shown in FIGS. 6 and 7, shown assembled.
Figure 8:
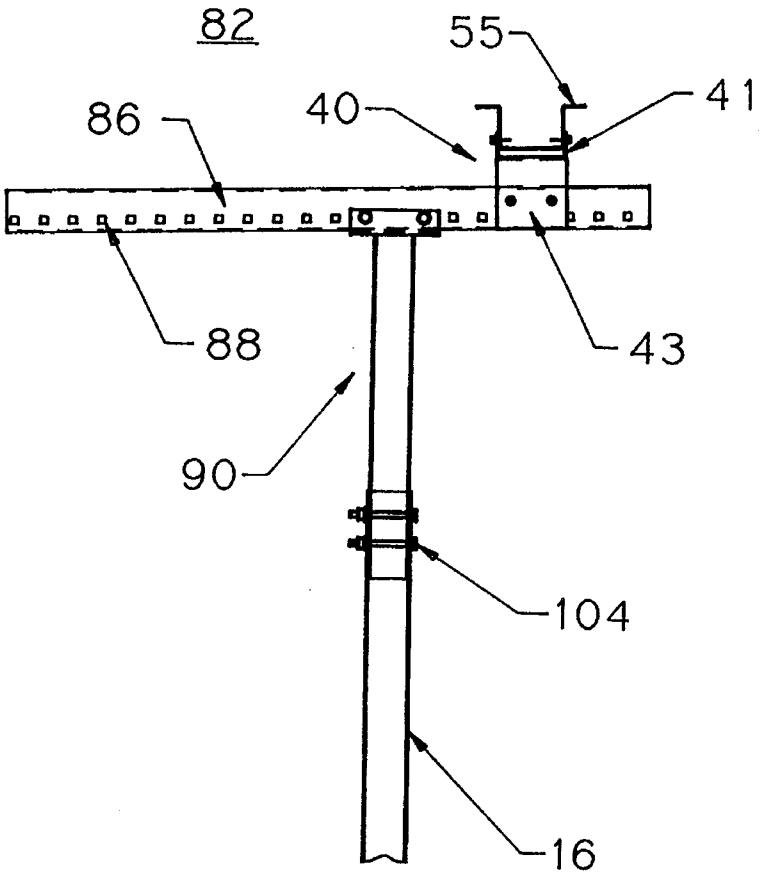
FIG. 8 is a schematic side view of the first adjustable support structure shown in FIGS. 6 and 7, shown assembled.

FIG. 9 illustrates the second support structure 84, which is similar to the first support structure 82. For illustration purpose, the extender 92 is shown as being shorter than the extender 90 of FIG. 8, in order to graphically exemplify the adjustability feature of the support devices 82 and 84.

While not illustrated, the support structure 82 can be gradually or incrementally reinforced, with the reinforcement being stronger, closer to ground level, where a large seismic plate 111 is simultaneously connected to the post 16 (or the lower extender 110) and to the ground.

Figure 10:
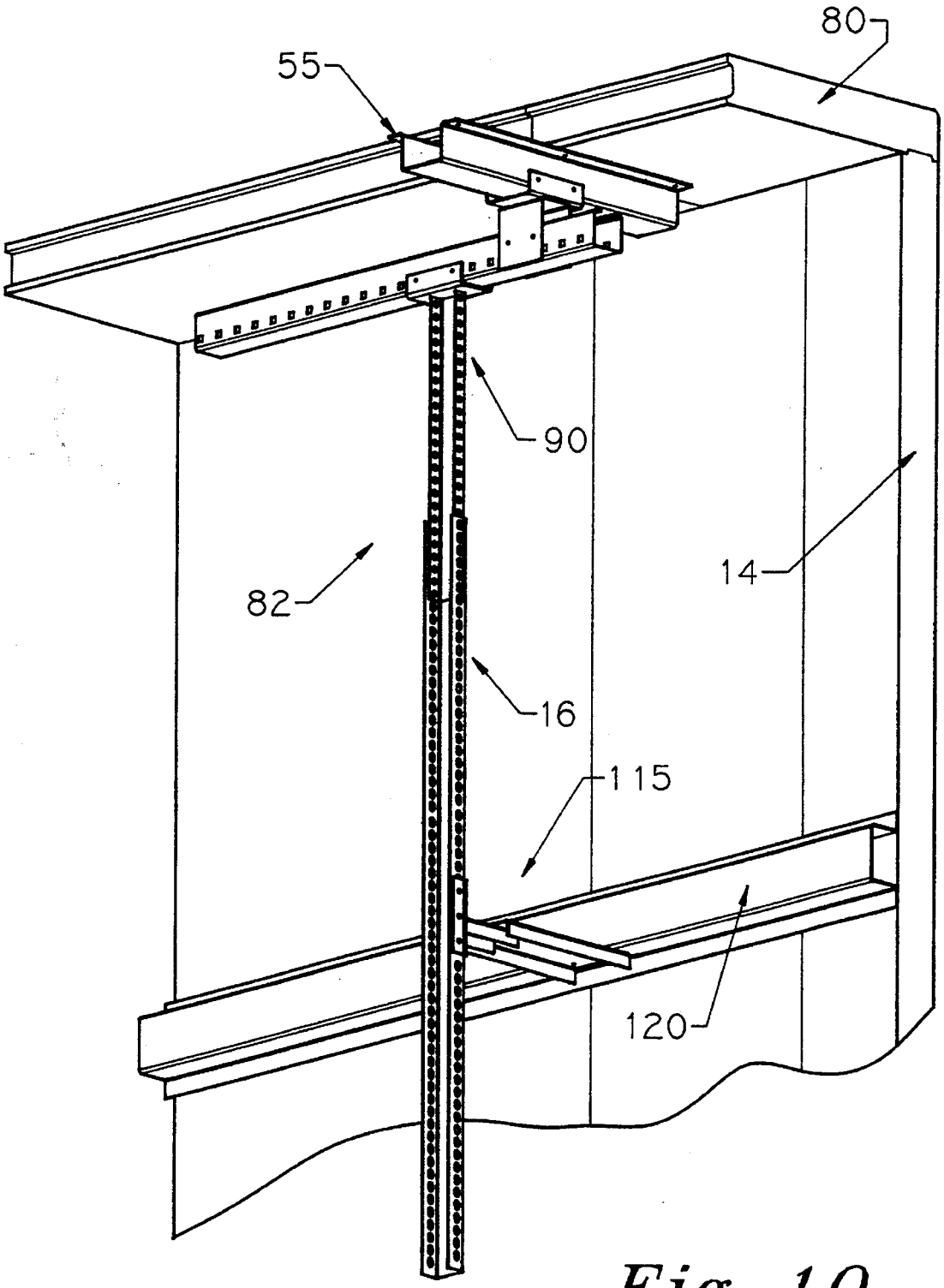
FIG. 10 is another schematic view of the first support structure of FIG. 9, also illustrating a bow girt assembly according to the present invention.
Figure 11:
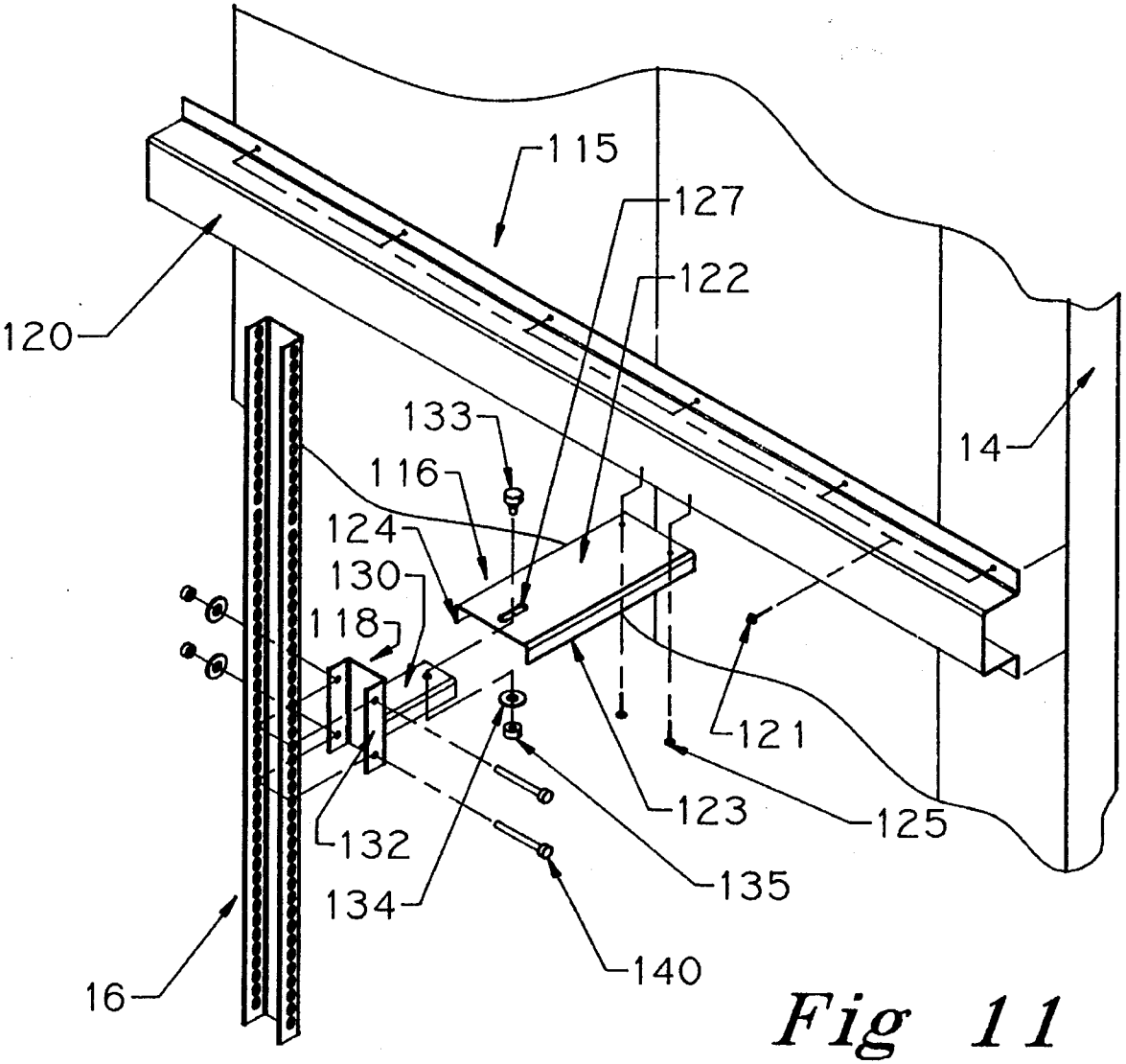
FIG. 11 is an enlarged exploded view of the bow girt assembly of FIG. 10.
Figure 12:
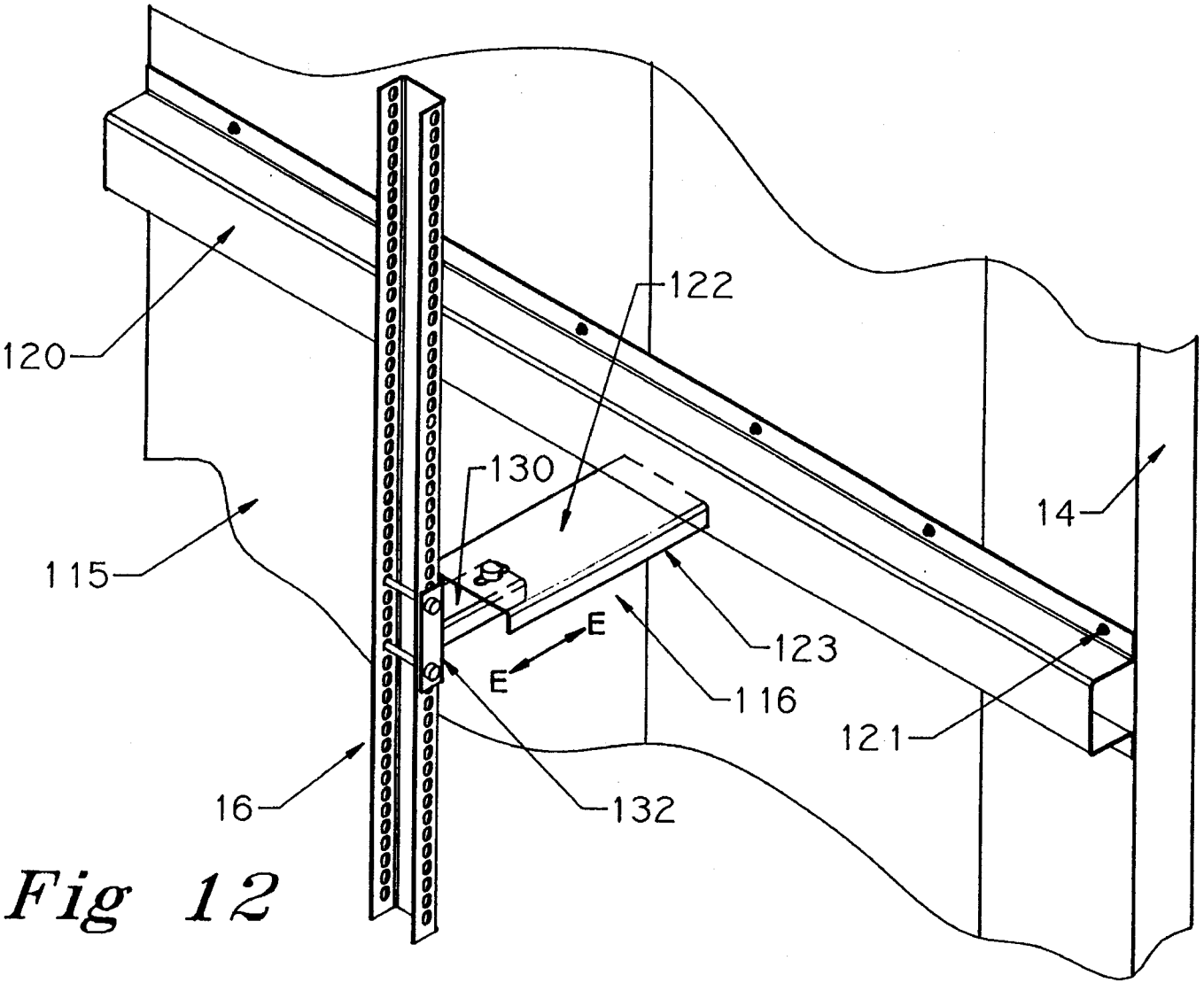
FIG. 12 is an enlarged isometric view of the bow girt assembly of FIGS. 10 and 11, shown assembled.

FIGS. 10, 11 and 12 illustrate a bow girt assembly 115 according to the present invention. The bow girt assembly 115 functions as a thermal bow girt as well as a wind girt, and is assembled with the support structure 82. The bow girt 115 can act as an adjustable or fixed thermal bow, and as an adjustable or fixed wind girt. As a result, the present invention achieves significant reduction in labor, parts and costs.

In temperature controlled buildings, such as refrigeration buildings, the use of thermal bow girts is necessary to restrict the thermal bow of the building. Conventionally, thermal bow systems have been used to control the thermal bow, by restricting the bow to a predetermined minimum range. According to the present invention, the building is allowed to flux with temperature variation, and the bow is controlled within an optimal or a maximum range. Consequently, the same thermal bow assembly can also be used simultaneously as a wind girt assembly.

The bow girt assembly 115 will now be described in greater detail. The bow girt assembly 115 includes an outer girt bracket 116, an inner girt bracket 118, and channel 120. The channel 120 is secured to the wall panels 14 at a predefined position therealong, at the optimal or maximum bow region, for instance, half way between the ceiling 80 and floor structure. The channel 120 extends across a selected number of wall panels 14. In the alternative, the channel 120 extends along the entire perimeter of the building. The channel 120 is similar in shape, dimensions and construction to the purlins 55, and is connected to the wall panels 14 by conventional means, such as self tapping screws 121.

The outer bow girt bracket 116 includes a central fiat section 122 which extends into two shoulders 123 and 124. One end of the central section 122 is secured to the channel 120 by means of self tapping screws 125. While FIG. 12 shows the central section 122 as being secured to the underside of the channel 120, it is contemplated that the central section can be secured to the upper side of the channel 120. The other end of the flat section 122 includes an elongated slot 127 for adjustable connection to the inner girt bracket 118.

The inner girt bracket 118 includes a generally U-shaped extension 130, which is secured to a saddle 132. The extension 130 is adjustably connected to the flat section 122, by means of a shoulder bolt 133, a washer 134 and a nut 135, in order to permit the outer girt bracket 116 to move relative to the extension 130, and thus relative to the inner girt bracket 118. Therefore, the length of the bore 127 determines the allowable bow range of the wall panels 14. The outer girt bracket 116 moves slidably along the direction E-E shown in FIG. 12.

If it is desired to fixedly secured the outer and the inner girt brackets 116 and 118, respectively, the shoulder bolt 133 is replaced by one or more regular bolts which are tightened to the flat section 122 against the extension 130. The saddle section 132 is secured to the post 16, at a predetermined position along its length, by means of bolts 140.

Among other important considerations to be considered in the design of the bow girt assembly 115 are: (1) the distance between the post 16 and the wall panels 14, and (2) the extent of exposure of the wall panels 14 to thermal and wind changes. Thus, it is contemplated by the present invention that some of the walls, which are most exposed to thermal and wind changes, be equipped with more bow girt assemblies than the remaining walls. In another design, the number of bow girt assemblies is proportional to such changes. In yet another design, all the walls are equipped with the same number of bow girt assemblies, irrespective of thermal and wind changes.

While particular embodiments of the present invention have been disclosed, it is to be understood that various different modifications are possible and are contemplated within the scope of the specification, drawings, abstract and appended claims.

What is claimed is:

1. An adjustable support structure used to support a roof, comprising in combination:

a. a plurality of upright posts, each having an uppermost end, wherein at least two of said plurality of posts are adjacently positioned;

b. a load beam assembly adjustably secured to at least two adjacent posts at about their uppermost ends, said load beam assembly extending substantially along the horizontal direction between said at least two adjacent posts, said load beam being generally adjustable relative to said at least two adjacent posts along the vertical direction, and said load beam being positioned at a distance from the roof;

c. a bracket adjustably secured to said load beam assembly, said bracket being generally relocatably adjustable relative to said load beam assembly along the horizontal direction, between two adjacent posts; and d. at least one purlin secured to said bracket for supporting the roof at a predetermined distance above said load beam assembly and said bracket.

2. The adjustable support structure according to claim 1, wherein said load beam assembly includes two load beam sections;

wherein each load beam section extends between, and is secured to two adjacent posts; and wherein at least one bracket is adjustably secured to each load beam section.

3. The adjustable support structure according to claim 1, wherein said load beam assembly includes at least a single continuous load beam section;

wherein said continuous load beam section extends between, and is secured to said at least two adjacent posts; and wherein at least one bracket is adjustably secured to said continuous load beam section, between said at least two adjacent posts.

4. The adjustable support structure according to claim 1, further including at least one extender that is adjustably secured, along the vertical direction, to said uppermost end of one of said plurality of posts and to said load beam assembly.

5. The adjustable support structure according to claim 1, wherein said bracket includes a seat that is secured to a saddle;

wherein said saddle is secured to said load beam assembly, and is adjustably connected thereto; and wherein said seat is fixedly connected to a purlin.

6. The adjustable support structure according to claim 4, wherein said bracket includes a seat that is secured to a saddle;

wherein said saddle is secured to said load beam assembly, and is adjustably connected thereto; and wherein said seat is fixedly connected to a purlin.

7. The adjustable support structure according to claim 6, wherein said extender includes a seat which supports, and which is connected to said load beam assembly.

8. The adjustable support structure according to claim 7, wherein said seat is adjustably connected to said load beam assembly along the horizontal direction.

9. The adjustable support structure according to claim 8, wherein said extender further includes a column which is secured to said seat and which is adjustably secured to one of said plurality of posts generally along the vertical direction.

10. The adjustable support structure according to claim 9, wherein said extender column is generally U-shaped and includes a central flat section, and two parallel side flanges; and wherein said side flanges include a plurality of through holes for adjustable connection to said one of said plurality of posts to which said extender is secured.

11. The adjustable support structure according to claim 9, wherein said extender column slides along said one of said plurality of posts to which said extender is secured to a desired position, in order to provide a desired adjustment to said load beam assembly.

12. The adjustable support structure according to claim 1 further defining a rack storage system.

13. The adjustable support structure according to claim 1, further including a bow girt assembly; and wherein said girt assembly includes:

an outer girt bracket;

an inner girt bracket; and a channel secured to a wall at a optimal bow region of the wall;

wherein said outer girt bracket is slidably connected to said inner girt bracket; and wherein said outer girt bracket and said inner girt bracket are connected between a post and the wall.

14. A bow girt assembly for simultaneous use as a thermal bow girt and a wind girt, said low girt assembly connected to a post of a support structure, the girt assembly comprising in combination:

a. an outer girt bracket;

b. an inner girt bracket; and c. a channel secured to a wall at a optimal bow region of the wall;

wherein said outer girt bracket is slidably connected to said inner girt bracket; and wherein said outer girt bracket and said inner girt bracket are connected between the post and the wall.

15. The bow girt assembly according to claim 14, wherein said optimal bow region is the maximum bow region of the wall.

16. The adjustable support structure according to claim 15, wherein said channel extends along the entire perimeter of the wall.

17. The adjustable support structure according to claim 14, wherein said outer girt bracket includes a central flat section which extends into two shoulder, said two shoulders defining a proximal and a distal end;

wherein said distal end of said central section is secured to said channel; and wherein said proximal end of said central section includes an elongated slot for adjustable connection to said inner girt bracket.

18. The adjustable support structure according to claim 17, wherein said inner girt bracket includes a generally U-shaped extension which is secured to a saddle.

19. The adjustable support structure according to claim 18, wherein said extension is adjustably connected to said central flat section by means of one or more shoulder bolts, in order to permit said outer girt bracket to slidably move relative to said U-shaped extension, and thus relative to said inner girt bracket.

* * * * *